US007517258B1

(12) United States Patent
Taylor

(10) Patent No.: US 7,517,258 B1
(45) Date of Patent: Apr. 14, 2009

(54) HERMETICALLY SEALED COAXIAL TYPE FEED-THROUGH RF CONNECTOR

(75) Inventor: Edward Allen Taylor, West Melbourne, FL (US)

(73) Assignees: H-Tech, LLC, West Melbourne, FL (US); SRI Hermetics Inc., Melbourne, FL (US)

( * ) Notice: Subject to any disclaimer, the term of this patent is extended or adjusted under 35 U.S.C. 154(b) by 6 days.

(21) Appl. No.: 11/668,085

(22) Filed: Jan. 29, 2007

Related U.S. Application Data

(60) Provisional application No. 60/763,572, filed on Jan. 31, 2006.

(51) Int. Cl.
*H01R 13/405* (2006.01)

(52) U.S. Cl. ..... 439/736; 29/856

(58) Field of Classification Search ..... 439/736, 439/589, 580, 598, 278, 578, 579; 29/856, 29/858, 883, 884, 428, 450, 572.2, 530
See application file for complete search history.

(56) References Cited

U.S. PATENT DOCUMENTS 3,702,420 A * 11/1972 Cooper ..... 361/120
3,922,477 A * 11/1975 Glowacz ..... 174/18
4,174,145 A * 11/1979 Oeschger et al. ..... 439/589
4,206,963 A * 6/1980 English et al. ..... 439/581
4,690,480 A 9/1987 Snow et al. ..... 439/364
4,913,673 A * 4/1990 Kobler ..... 439/736
4,976,634 A * 12/1990 Green et al. ..... 439/589
5,041,019 A 8/1991 Sharp et al. ..... 439/559
5,109,594 A 5/1992 Sharp et al. ..... 29/600
5,110,307 A 5/1992 Rapoza ..... 439/566
5,295,866 A * 3/1994 Kroger et al. ..... 439/589
5,298,683 A 3/1994 Taylor ..... 174/152
5,405,272 A 4/1995 Rapoza ..... 439/566
5,518,427 A * 5/1996 Kan et al. ..... 439/736
5,571,033 A * 11/1996 Kinsey et al. ..... 439/595
5,986,208 A 11/1999 Taylor ..... 174/50.58
6,037,787 A * 3/2000 Corwith ..... 324/754
6,841,731 B1 * 1/2005 Zanello ..... 174/50.56
7,011,529 B2 * 3/2006 Oldfield et al. ..... 439/63
7,144,274 B2 * 12/2006 Taylor ..... 439/586
7,300,310 B2 * 11/2007 Taylor ..... 439/586

* cited by examiner

*Primary Examiner*—T C Patel
*Assistant Examiner*—Harshad C Patel
(74) *Attorney, Agent, or Firm*—Allen, Dyer, Doppelt, Milbrath & Gilchrist, P.A.

(57) ABSTRACT

An improved feed-through RF connector uses structural materials with coefficients of thermal expansion selected to enhance the reliability of a hermetic seal. The design of the connector and the selection of materials facilitate easy installation and help avoid cyclic fatigue and cracks that could result in a loss of hermetic seal.

18 Claims, 6 Drawing Sheets

HERMETICALLY SEALED COAXIAL TYPE FEED-THROUGH RF CONNECTOR

CROSS REFERENCE TO RELATED APPLICATIONS

This application claims priority to provisional patent application 60/763,572 by inventor Edward A. Taylor filed on Jan. 31, 2006, entitled "Hermetically Sealed Coaxial Type Feed-Through RF Connector", the contents of which are incorporated herein by reference in their entirety.

BACKGROUND OF THE INVENTION

1. Field of the Invention

The invention is directed to electrical connectors and, more particularly, to the field of coaxial type feed-through RF connectors that require hermetic sealing.

2. Description of the Prior Art

The prior art will be discussed in conjunction with FIGS. 1-3.

FIG. 1 is a diagrammatic cross-sectional illustration of a conventional coaxial feed-through RF connector, having an RF signal ground-providing Kovar shell that projects outwardly beyond the surface of an aluminum housing having a bore in which the RF connector is soldered. For the RF connector shown in FIG. 1, as well as the connectors of FIGS. 2-5, to be described, it is to be understood that each of the illustrated components thereof is cylindrically symmetrical about that connector's longitudinal axis. The RF connector of FIG. 1 includes a longitudinal signal pin 10, which lies along a longitudinal axis 12 of the connector, and has a first, generally central portion 11 hermetically bonded to a coaxial bore 21 of a generally cylindrical dielectric (typically glass) spacer 20.

The outer cylindrical surface of the glass dielectric spacer 20 is contiguous with and hermetically bonded to a reduced diameter portion 31 of a surrounding conductive (metallic) shell 30, that serves as the RF signal ground for RF center pin 10. The RF ground-providing shell 30 is configured and sized to be soldered within a step-shaped connector support bore 40 of the connector's support housing 50, and to project outwardly beyond a first surface 51 thereof. A forward or distal end 13 of the signal pin 10 projects into an interior hollow bore 35 of the conductive shell 30 which, like the pin 10, is preferably made of relatively low CTE conductive ferrous material, such as Kovar which has a coefficient of thermal expansion of substantially 5.2 PPM/° C., so that it and the pin may be readily hermetically bonded to the glass/dielectric spacer 20, which has a similarly low CTE, that is compatible with that of Kovar.

The step-shaped bore 40 of the housing 50 extends from the first surface 51 thereof to a second, opposite surface 52 of the support housing, and includes respectively different diameter bore portions that are successively contiguous with one another and the first and second surfaces of the housing. In order to conform with the stepped configuration of the bore 40, the reduced diameter portion 31 of the shell 30 is sized to be inserted into and disposed adjacent to the interior surface of a reduced diameter portion 41 of the bore 40, so that a first, relatively narrow, cylindrical gap 45 is defined between the outer sidewall of the reduced portion 31 of the shell 30 and the interior surface of the reduced diameter portion 41 of the bore 40.

In addition, shell 30 has a relatively wide diameter portion 32, that adjoins the relatively narrow diameter portion 31 thereof, and forms a second, relatively thin, annular gap 46, that is contiguous with the first, relatively narrow, cylindrical gap 45, and is formed between the bottom surface of the relatively wide diameter portion 32 of the shell and the annular surface of a step portion 42 of the bore 40 that connects the reduced diameter portion 41 of the bore to a relatively wide diameter portion 43 thereof. The shell 30 is conductively and fixedly retained within the step-shaped bore 40 by means of solder joint 60. This solder joint is produced by flowing solder material into the gaps 45 and 46 from a ring or annular-shaped solder preform, that has been inserted into an annular cavity 65 formed between the outer sidewall of the relatively wide diameter portion 32 of the shell 30 and the inner sidewall of the relatively wide diameter portion 43 of the bore 40.

A second portion 14 of the connector's center pin 10 passes through a relatively narrow diameter portion 44 of the step-shaped bore 40, which extends between a relatively shallow, circular depression or counterbore 47, at the bottom of the reduced diameter portion 41 of the bore 40, and the second surface 52 of the housing 50, and terminates at an exterior end 15. Counterbore 57 serves as a break for solder travel, by increasing the solder's propagation distance, which reduces capillary action, so that the solder will not travel along the surface of the bottom of the reduced diameter portion 41 of the bore 40, but rather will remain confined within the gaps 46 and 45 forming solder joint 60.

FIG. 2 shows the architecture of a second type of conventional coaxial feed-through RF connector, the components of which are installed at a bottom portion of a threaded connector support bore that extends into the housing from a first surface thereof, so as to allow an associated externally threaded RF connector, such as one that terminates the end of a section of RF cable, to be screwed into the threaded surface of the bore and engage the RF signal center pin installed therein. As such, the conductive material of the housing forms part of the RF signal ground that surrounds the RF signal pin.

More particularly, like the first type of prior art coaxial RF connector shown in FIG. 1, the coaxial feed-through RF connector of FIG. 2 includes a longitudinal (Kovar) signal pin 10, which is colinear with the connector's longitudinal axis 12, and is hermetically bonded to a coaxial bore 21 of a generally cylindrical dielectric (glass) spacer 20. Rather than being hermetically bonded to an RF ground-providing metallic shell that projects outwardly from the support housing, as in the RF connector architecture of FIG. 1, the outer cylindrical surface of the glass spacer 20 of the RF connector of FIG. 2 is hermetically bonded to a surrounding metallic (e.g., Kovar) cylindrical ferrule 70. Ferrule 70, which serves as the RF signal ground, is installed within a cylindrical recess 80 beneath the bottom portion 91 of a threaded connector-support bore 90, that is formed (e.g., machined) into the housing 50 from the first surface 51 thereof. The forward or distal end 13 of the signal pin 10 projects from the glass spacer 20 into the interior hollow portion 95 of the threaded bore 90.

Similar to the relatively narrow diameter portion of the RF signal ground-providing shell of the coaxial feed-through RF connector of FIG. 1, the outer diameter of the ferrule 70 is slightly less than the diameter of the cylindrical recess 80, so that a relatively narrow, cylindrical gap 75 is formed therebetween. The RF signal ground-providing ferrule 70 of the connector of FIG. 2 is conductively and fixedly retained within recess 80 by means of solder joint 85 formed in the cylindrical gap 75. Solder joint 85 not only serves to physically affix the RF signal pin support structure within the housing, but provides an ohmic connection between the Kovar ferrule 70 and the aluminum housing 50, so that the housing provides part of the RF signal ground surrounding the RF signal pin 10. The solder joint 85 is produced by flowing solder material into the cylindrical gap 75 from a ring or annular-shaped solder preform, that has been inserted into an annular depression 66 that is contiguous with the cavity 80 and the bottom portion 91 of the threaded bore 90.

Also similar to the RF connector of FIG. 1, in the RF connector architecture of FIG. 2, a second portion 14 of the RF signal pin 10 passes through a relatively narrow diameter bore 100 in the housing 50, which extends between a relatively shallow, circular counterbore 102 at the bottom of the recess 80 and the second surface 52 of the housing, and terminates at an exterior end 15. As described previously, such a counterbore effectively prevents solder from traveling along the bottom of the recess 80, so that the solder remains confined within the relatively narrow, cylindrical gap 75, forming the intended solder joint 85.

In each of the coaxially configured RF connectors shown in FIGS. 1 and 2, the only reliable hermetic seals are those provided by the hermetic bond between the Kovar RF center pin and the glass spacer, and the hermetic bond between the glass spacer and the Kovar material of a surrounding RF signal ground-providing cylinder (shell 30 in FIG. 1, and ferrule 70 in FIG. 2). On the other hand, the solder joint that has been formed between the Kovar ferrule and the aluminum housing can be expected to suffer cyclic fatigue, producing cracks that will propagate and cause the solder joint to lose whatever temporary hermeticity it may have possessed when initially formed. This failure of such a solder joint is due to the substantial mismatch between the CTEs of Kovar and aluminum.

Still, if the connectors are relatively small sized, and the solder joints between metals having substantially different CTEs are formed in a dependable and repeatable manner, the types of connectors shown in FIGS. 1 and 2 are sometimes considered to be 'sufficiently' hermetically sealed, so as to conform with some industry standards. Namely, in some applications that require a hermetically sealed connector, the connectors of FIGS. 1 and 2, which are not reliably hermetically sealed structures, may be employed as an alternative to the preferred device.

One prior art approach to resolve the above-described CTE mismatch problem, that leads to solder joint fatigue and loss of any hermeticity that the solder joints of an RF connector may initially provide, involves laser-welding the RF signal ground-providing Kovar ferrule, to which the glass spacer supporting the Kovar RF signal pin is hermetically bonded, to a coaxial sleeve made of a dissimilar metal (e.g., aluminum), that has the same CTE as the (aluminum) support housing. The coaxial sleeve is made of Kovar and aluminum. Kovar ferrule is welded to Kovar portion of coaxial sleeve and the dissimilar metal (aluminum) coaxial sleeve is laser welded to a connector retention bore in the aluminum housing. One portion of the coaxial sleeve has the same CTE as the ferrule and the other portion of the sleeve has the same CTE as the housing. The sleeve is a transition joint for the Kovar feed thru to the aluminum housing. In such an alternative RF connector structure, the laser welds, which form individual hermetic seals, make up for the lack of reliable hermeticity of the solder joints employed in the RF connector architectures of FIGS. 1 and 2, so that the resulting RF connector is completely and reliably hermetically sealed to the aluminum support housing.

An example of a prior art RF connector architecture employing such laser-welds to hermetically join a dissimilar metal coaxial sleeve to the RF signal ground-providing (Kovar) cylinder surrounding the (Kovar) center pin, and to hermetically join the dissimilar metal coaxial sleeve to a connector retention bore in the (aluminum) housing, is diagrammatically illustrated in FIG. 3. As shown therein, like the coaxial feed-through RF connectors of FIGS. 1 and 2, the coaxial feed-through RF connector of FIG. 3 has a longitudinal (Kovar) RF signal pin 10 disposed along the connector's longitudinal axis 12, and hermetically bonded to a coaxial bore 21 of a generally cylindrical dielectric (glass) spacer 20. The glass spacer 20 abuts against the bottom portion 109 of an electrically conductive grounding spring 110. Grounding spring 110 is installed at the bottom 112 of a cylindrical recess 114 that is contiguous with and extends beneath the bottom portion 116 of a bore 120 formed into the housing 50 from top surface 51.

The forward or distal end 13 of the RF signal pin 10 projects from the glass spacer 20 into a hollow interior portion 122 of a threaded interior surface 124 of a cylindrical sleeve 125. Cylindrical sleeve, 125 includes a first, metallic sleeve portion 126, made of a metal (e.g., aluminum) that may be readily metallurgically joined with (e.g., welded) by way of a (laser) weld joint 132 to the metal (e.g., aluminum) of the housing 50. Sleeve 125 further includes a second, metallic sleeve portion 127, that adjoins the first sleeve portion 126, and is made of a metal, such as Kovar, that may be readily (laser) welded at 133 to a metallic (e.g. Kovar) ferrule 128, which is coaxially adjacent to the second sleeve portion 127. The first, metallic sleeve portion 126 is metallurgically joined to the second, metallic sleeve portion 127 by way of an explosion weld joint 130 therebetween. Kovar ferrule 128, has a lower projection portion 129 and is hermetically bonded to the outer surface of the glass spacer 20. In the connector's installed position, the lower projection portion 129 of the Kovar ferrule 128 is urged against the bottom portion 109 of the grounding spring 110, so that the bottom portion 109 of the grounding spring 110 is firmly captured between the Kovar ferrule 128 and the bottom 112 of the bore 120. In addition, an upper portion 111 of the grounding spring 110 abuts against a bottom surface 131 of the Kovar ferrule 128. As a consequence, the grounding spring 110 provides a secure RF ohmic signal ground connection between the Kovar ferrule 128 and the conductive material of housing 50.

The outer diameters of the sleeve 126 and the ferrule 128 are slightly less than the diameter of the cylindrical bore 120, so that, once the Kovar sleeve portion 127 of sleeve 125 and the Kovar ferrule 128 have been welded together at laser weld joint 133, they may be readily inserted into the cylindrical bore 120. After being inserted into the bore 120, the combined (explosion-welded) sleeve and ferrule structure is hermetically sealed with the aluminum of the surrounding housing, by laser-welding the (aluminum) sleeve portion 126 of the sleeve 125 to the adjoining portion of the surface 51 of the (aluminum) housing 50, so as to produce laser-weld joint 132 therebetween.

Now, although explosion- and laser-welds, such as those employed in the coaxial RF connector architecture of FIG. 3, may be employed to form hermetic seals between RF connector components having dissimilar CTEs, and thereby remedy problems associated with the use of solder joints, such as the formation and propagation of cracks in the joints as result of cyclic fatigue, the processing techniques necessary to form such welds are relatively complicated, which makes the connectors expensive and often increase the size of the connectors.

PROBLEMS OF THE PRIOR ART

Connectors of the prior art have difficulty forming a reliable hermetic seal within a bore of an electronics containing support housing made of a relatively high co-efficient of thermal expansion (CTE) material. In addition, the connectors must provide a reliable electrical ground.

BRIEF SUMMARY OF THE INVENTION

The present invention relates in general to a coaxial feed-through radio frequency (RF) connector, having a configuration and containing structural materials that enable the connector to be reliably hermetically sealed within a bore of an electronics-containing support housing made of a relatively high coefficient of thermal expansion (CTE) material (such as aluminum), by means of a relatively simple solder joint. To this end, the coaxial type feed-through RF connector of the invention employs an RF signal ground-providing shell, formed of the combination of a stainless steel sleeve, that is generally flush with the top of the support housing, and a Kovar ferrule joined with the stainless steel sleeve.

Because the CTE (17.5) of the stainless steel sleeve is sufficiently close to the relatively high CTE (22) of aluminum, soldering the stainless steel sleeve to the aluminum housing is sufficient to provide a reliable hermetic seal between the connector and the housing. Moreover, the slightly higher value of the CTE of aluminum relative to the value of the CTE of stainless steel causes the solder joint to retain the stainless steel sleeve under a slight compression, which is desirable for maintaining the reliability of the hermetic seal. The adjoining Kovar ferrule is also connected to (an interior region of) the housing by means of a solder joint; although this solder joint is non-hermetic, it provides a secure ohmic RF signal ground connection between the housing and the RF connector's conductive shell. A ground spring as shown in FIG. 6 can also be employed.

In a first embodiment, the shell's stainless steel sleeve is adjacent to the sidewall of a bore formed within, and flush with the outer surface of a raised cylindrical land portion of the aluminum support housing. In a second embodiment, the internal surface of the stainless steel sleeve is threaded and, when inserted into a connector retention bore, is adjacent to the sidewall of the bore and flush with the surface of the housing. Threading the internal surface of the stainless steel sleeve allows an associated externally threaded RF connector, such as one that terminates the end of a section of RF cable, to be screwed into the sleeve and engage an RF signal center pin hermetically bonded to a dielectric spacer, that is also hermetically bonded to the Kovar ferrule at the bottom of the bore.

DETAILED DESCRIPTION OF THE INVENTION

In accordance with the present invention, the drawbacks of conventional coaxial feed-through RF connector architectures, including the problems of cyclic fatigue in solder joints used to join metallic components having substantially different CTEs, and processing complexity and relatively high cost associated with using explosion and laser welding techniques to join dissimilar metallic components, described above, are effectively obviated by a new and improved coaxial type feed-through RF connector structure, that employs an RF signal ground-providing shell that contains both a Kovar ferrule (to provide a hermetic seal with a glass spacer, in which a Kovar RF signal pin hermetically retained) and a stainless steel sleeve (that is laser-welded, rather than soldered, to the Kovar ferrule, due to the substantial difference in the CTEs of Kovar and stainless steel).

Because the CTE of the stainless steel sleeve is substantially greater than the CTE of Kovar, it is sufficiently close to the relatively high CTE of aluminum, to enable a reliable hermetic seal to be achieved between the connector's RF signal ground-providing shell and the sidewall of a bore within an aluminum support housing, by means of a relatively simple, and inexpensive solder joint formed within a narrow cylindrical gap between the aluminum of the sidewall of the bore and the stainless steel of the sleeve portion of the RF signal ground-providing shell.

Figure 4:
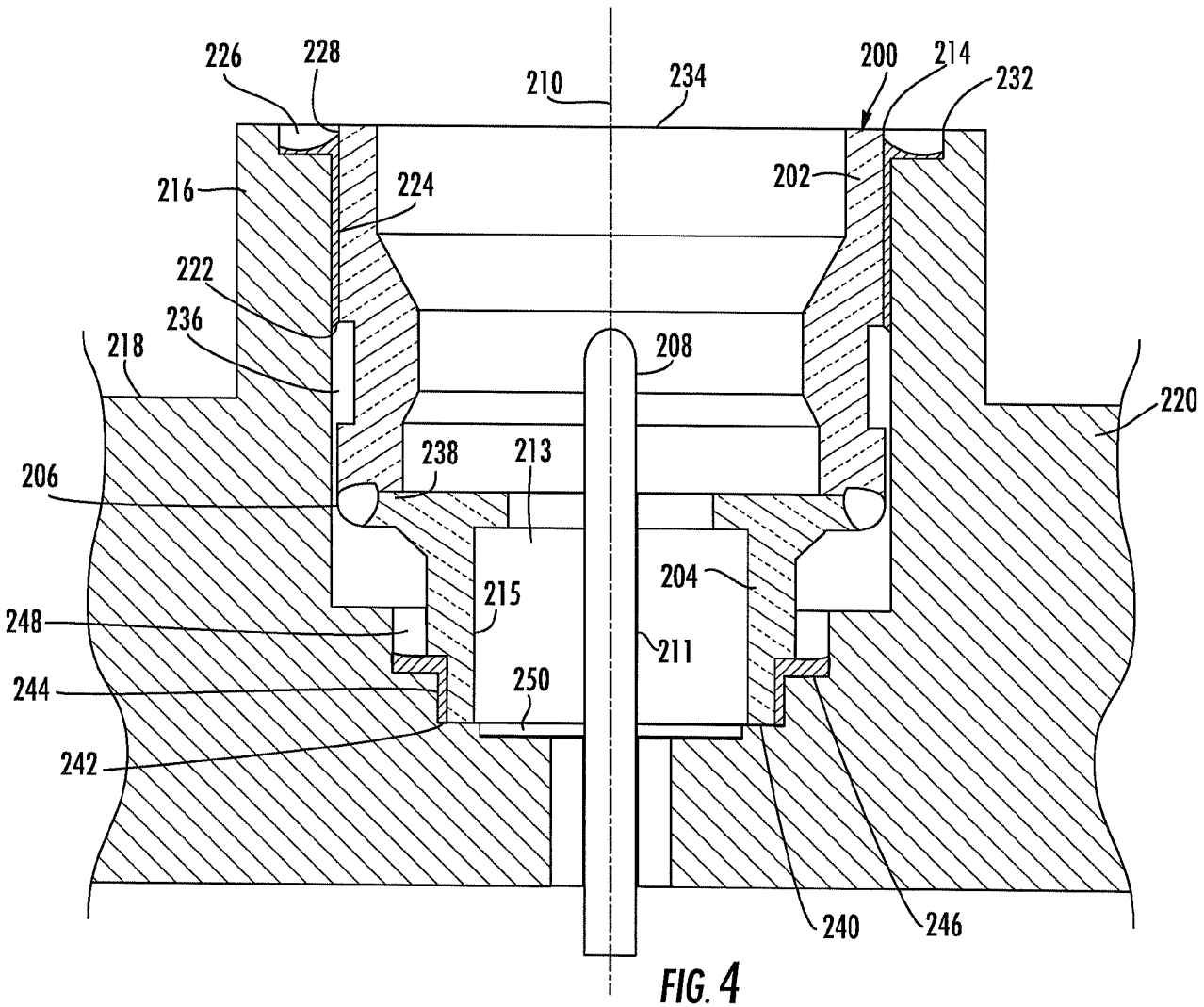
FIG. 4 is a diagrammatic cross-section of a first embodiment of a coaxial type feed-through RF connector of the present invention, having an RF signal ground-providing shell containing a stainless steel sleeve and an adjoining Kovar ferrule, and being hermetically sealed by a solder joint to the sidewall of a bore within a raised cylindrical land portion of an aluminum support housing.

A diagrammatic cross-section of a first embodiment of a coaxial type feed-through RF connector of the present invention is shown in FIG. 4 as comprising a generally cylindrical, electrically conductive (e.g., metallic) shell 200, having an outer sleeve 202 and an inner ferrule 204 that is laser-welded to the outer sleeve at laser-weld joint 206. Once the sleeve 202 has been laser-welded to the inner ferrule, the shell 200 is subjected to a precious metal (electro-)plating process (which typically involves plating an initial thin layer of nickel, followed by plating a thin layer of gold on the nickel plate), to make the shell wettable to solder that will be used to join respective spaced apart surface portions of the aluminum sidewall of the bore to each of the outer sleeve 202 and the ferrule 204.

The shell 200 surrounds one or more RF signal pins, such as a RF signal center pin 208, that is coaxial with the axis 210 of the RF connector, and is hermetically bonded to a bore 211 through a glass spacer 213. The outer surface of the glass spacer 213 is hermetically bonded to the interior sidewall 215 of ferrule 204. Each of the ferrule 204 and the RF pin 208 is preferably made of a material such as Kovar, having a CTE proximate to that of glass dielectric material of the spacer 213, so that the glass spacer 213 may be readily hermetically bonded with the ferrule and the RF pin. The shell's outer sleeve 202 is sized to fit within a main portion 212 of a bore 214 formed within a raised cylindrical land portion 216 of an aluminum housing 220, the land portion 216 projecting beyond a first surface 218 of the housing. Specifically, the shell's outer sleeve 202 has an outer diameter that is only slightly less than the inner diameter of the main portion 212 of the bore 214, so that a relatively narrow cylindrical gap 222 is formed between the outer surface of the sleeve 202 and the interior sidewall of the main portion 212 of the bore.

The outer sleeve is preferably made of a material, such as stainless steel, that has a coefficient of thermal expansion (CTE) proximate or relatively close to that of the housing. These two aspects of the sleeve (its size and material) relative to the metal of the sidewall of the bore allow the sleeve to be reliably hermetically sealed within the bore 214 by means of a relatively simple, upper solder joint 224 that is formed within the narrow cylindrical gap 222 between the sleeve 202 and the sidewall of the bore 214. As in the connectors of FIGS. 1 and 2, upper solder joint 224 may be readily formed by flowing solder into the cylindrical gap 222 from an annular-shaped solder preform. The solder preform is placed into an annular cavity 226, that is formed in the raised cylindrical land portion 216 of the aluminum housing between the outer sidewall 228 of the stainless steel sleeve 202 and the sidewall 230 of an annular recess 232, in the top surface 234 of raised cylindrical land portion 216 of the aluminum housing, that is contiguous with the bore 214. From the preform in the cavity 226, the solder flows into the gap 222. To constrain the depth to which solder flows down through the cylindrical gap 222, an annular recess 236 is formed in the outer sidewall 228 of the sleeve 202, interrupting further solder travel, so as to maintain a specific volumetric quantity of solder within cylindrical gap 222. Because the CTE (22) of the aluminum housing 220 is slightly higher than the CTE (17.5) of the stainless steel sleeve 202, the solder joint 224 retains the stainless steel sleeve 202 within the bore 214 under a slight compression, which is desirable for maintaining the reliability of the hermetic seal.

As described above, due to the substantial mismatch between their respective CTEs, the stainless steel sleeve 202 is laser-welded to the inner ferrule 204, in order to provide a hermetic seal therebetween. For this purpose, a first end of the ferrule 204 adjoining the sleeve 202 includes a ring-shaped flange 238, which has a diameter proximate that of the outer sleeve 202. In order to provide a secure RF signal ground connection for the RF connector, a second or lower end 240 of the ferrule 204 is sized to be inserted into and form a relatively narrow cylindrical gap 242 with the interior sidewall of a reduced diameter, bottom portion 244 of the bore 214. Similar to the cylindrical gap 224 between the outer sleeve 202 and the bore 214, the relatively narrow cylindrical gap 242 between the second end 240 of the ferrule 204 and the interior sidewall of the reduced diameter, bottom portion 244 of the bore 214 enables the ferrule to be conductively joined to the (aluminum) housing material surrounding the bore, by means of a relatively simple solder joint 246 formed along the narrow cylindrical gap 242 between the ferrule 204 and the sidewall of the bottom portion 244 of the bore.

The solder joint 246 may be formed by flowing solder into the cylindrical gap 242 from an annular-shaped solder preform, that has been placed in an annular cavity 248 formed between the sidewall of the bore 214 and the outer sidewall of the ferrule 204, and contiguous with the gap 242. From the solder preform that has been placed in the cavity 248, solder flows down into the gap 224. A counterbore 250 is formed adjacent to the floor of the bore 214 beneath the glass spacer 213, to prevent solder that has flowed into the gap 242, where the solder joint 246 is intended, from traveling along the bottom of the bore 214.

Because the CTE (22) of the aluminum housing 220 is substantially higher than the CTE (5.2) of the Kovar ferrule 204, the lower solder joint 246 does not, nor is it intended to, form a hermetic seal between the RF connector and the support housing; a reliable hermetic seal therebetween is provided by way of the upper solder joint 224, as described above. Instead, the purpose of the lower solder joint 246 is to provide a secure ohmic RF signal ground connection between the shell 200 and the surrounding aluminum housing 220. Rather than form a solder joint, such as that shown at 246 between the ferrule 204 and the bottom portion 244 of the bore, to provide a secure ohmic RF signal ground connection between the shell 200 and the surrounding aluminum housing, a grounding spring, configured and installed in the manner of the connector of FIG. 3, described previously, may be employed.

Figure 5:
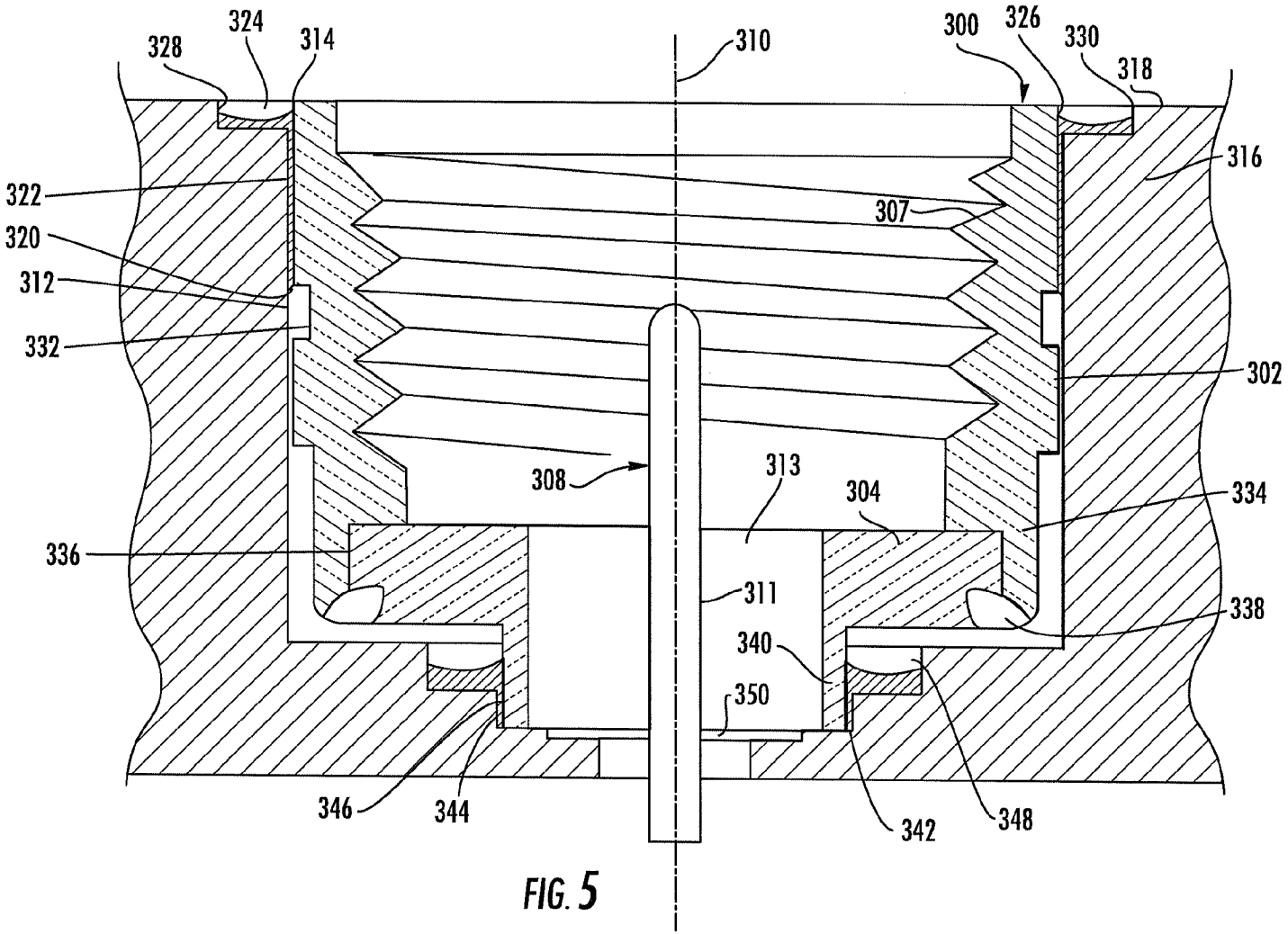
FIG. 5 is a diagrammatic cross-section of a second embodiment of a coaxial type feed-through RF connector of the present invention having an RF signal ground-providing shell containing an internally threaded stainless steel sleeve and an adjoining Kovar ferrule, and being hermetically sealed by a solder joint to the sidewall of a bore within an aluminum support housing.

A diagrammatic cross-section of a second embodiment of a coaxial type feed-through RF connector of the present invention is shown in FIG. 5 as comprising a generally cylindrical, electrically conductive (e.g., metallic) shell 300, having an outer sleeve 302 and an inner ferrule 304 that is laser-welded to the outer sleeve at laser-weld joint 338. Once the stainless steel sleeve 302 has been laser-welded to the ferrule 304, the shell is subjected to a precious metal (electro-)plating process as described above for the embodiment of FIG. 4 so as to make the shell wettable to solder that will be used to join respective spaced apart surface portions of the aluminum sidewall of the bore to each of the outer sleeve 302 and the ferrule 304.

The shell's outer sleeve 302 has a threaded interior surface 307, that allows an externally threaded RF connector to be screwed into the shell and engage one or more RF signal pins, such as the single RF signal center pin 308 shown in these figures, that is coaxial with the axis 310 of the RF connector, and is hermetically bonded to a coaxial bore 311 through a glass spacer 313. The outer surface of the glass spacer 313 is hermetically bonded to the interior sidewall 315 of the ferrule 304. As in the embodiment of FIG. 4, each of the ferrule 304 and the RF pin 308 is preferably made of a material such as Kovar, having a CTE proximate to that of glass dielectric material of the spacer 313, so that the glass spacer 313 may be readily hermetically bonded with the ferrule and the RF pin.

The shell's internally threaded outer sleeve 302 is sized to fit within a main portion 312 of a bore 314 that extends into an aluminum housing 316 from a first surface 318 thereof. As in the embodiment of FIG. 4, the sleeve 302 has an outer diameter that is only slightly less than the inner diameter of the main portion 312 of the bore 314, so that a relatively narrow cylindrical gap 320 is formed between the outer surface of the sleeve 302 and the interior sidewall of the main portion 312 of the bore 314.

Like the embodiment of FIG. 4, the outer sleeve 302 is preferably made of a material, such as stainless steel, that has a coefficient of thermal expansion (CTE) proximate or relatively close to that of the housing, so as to allow the sleeve to be reliably hermetically sealed within the bore 314 by means of a relatively simple, upper solder joint 322 formed along the narrow cylindrical gap 320 between the outer sleeve 302 and the adjacent sidewall of the bore 314. As in the connector of FIG. 4, the upper solder joint 322 may be formed by flowing solder into the cylindrical gap 320 from an annular-shaped solder preform, that has been placed into an annular cavity 324 formed between the outer sidewall 326 of the stainless steel sleeve 302 and the sidewall 328 of an annular recess 330, in the top surface 318 of the aluminum housing, that is contiguous with the bore 314. From the preform that has been placed in the annular cavity 324, solder flows into the gap 320. To constrain the depth to which solder flows down along the cylindrical gap 320, an annular recess 332 is formed in the outer sidewall 326 of the sleeve 302, thereby interrupting further solder travel, and ensuring that a specific volumetric quantity of solder is maintained within the cylindrical gap 320. Again, because the CTE (22) of aluminum is slightly higher than the CTE (17.5) of stainless steel, the stainless steel sleeve 302 is retained by the solder joint 322 under a slight compression which, as noted above, is desirable for maintaining the reliability of the hermetic seal.

As with the case of the connector of FIG. 4, due to the substantial mismatch between their respective CTEs, the stainless steel sleeve 302 is laser-welded to the inner ferrule 304, in order to provide a hermetic seal therebetween. For this purpose, a lower end portion 334 of the sleeve 302 has a recess or depression 336 of a diameter and depth that substantially correspond to the diameter and thickness, respectively of the ferrule 304, so as to accommodate a relatively 'snug' insertion of the ferrule 304 into the recess 336 of the sleeve 302, ferrule being laser-welded to the sleeve along their adjoining surfaces at the outer edge of the recess, as shown by weld-joint 338.

In order to provide a secure RF signal ground connection for the RF connector, a lower, reduced diameter portion 340 of the ferrule 304 is sized to be inserted into and form a relatively narrow cylindrical gap 342 with the interior sidewall of a reduced diameter, bottom portion 344 of the bore 314. Similar to the cylindrical gap 320 between the outer sleeve 302 and the bore 314, the relatively narrow cylindrical gap 342 between the lower, reduced diameter portion 340 of the ferrule 304 and the interior sidewall of the reduced diameter, bottom portion 344 of the bore 314 enables the ferrule to be conductively joined to the (aluminum) housing material surrounding the bore, by means of a relatively simple, lower solder joint 346 formed along the narrow cylindrical gap 342 between the ferrule 304 and the sidewall of the bottom portion 344 of the bore.

As in the embodiment of FIG. 4, the solder joint 346 may be formed by flowing solder into the cylindrical gap 342 from an annular-shaped solder preform, that has been placed in an annular cavity 348, that is formed between the sidewall of the bore 314 and the outer sidewall of the ferrule 304, and is contiguous with the gap 342. From this preform, solder flows down into the gap 324 to the bottom portion 344 of the bore 314. A counterbore 350 is formed adjacent to the bottom floor of the bore 314 beneath the glass spacer 313, to prevent solder that has flowed into the gap 342, where the solder joint 346 is intended, from traveling along the bottom of the bore 314.

Again, like the embodiment of FIG. 4, because the CTE (22) of the aluminum housing 316 is substantially higher than the CTE (5.2) of the Kovar ferrule 304, the lower solder joint 346 does not, nor is it intended to, form a hermetic seal between the RF connector and the support housing; a reliable hermetic seal therebetween is provided by way of the upper solder joint 322, as described above. Instead, the purpose of the lower solder joint 346 is to provide a secure ohmic RF signal ground connection between the shell's Kovar ferrule 304 and surrounding aluminum housing 316. Also, as in the embodiment of FIG. 4, described above, rather than using a solder joint, such as the lower solder joint shown at 346 between the Kovar ferrule 304 and the bottom portion of the bore 314, to provide a secure ohmic RF signal ground connection between the shell 300 and the surrounding aluminum housing 316, the connector architecture of FIG. 5 may be modified to employ a grounding spring of the type shown in FIG. 3, described previously.

Figure 3:
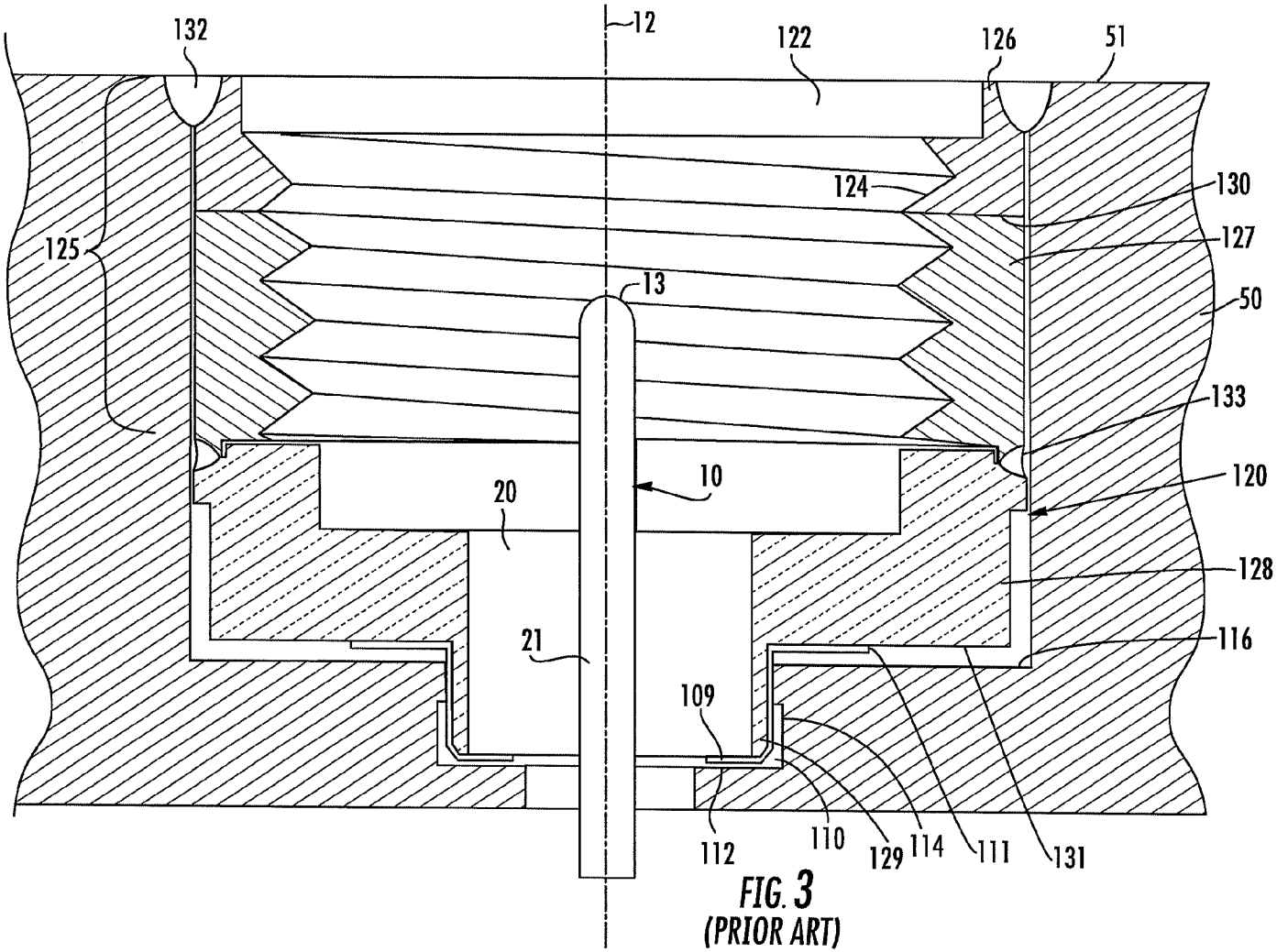
FIG. 3 (PRIOR ART)
FIG. 3 is a diagrammatic cross-sectional illustration of a third type of conventional coaxial feed-through RF connector, which employs laser-welds to hermetically join a dissimilar metal coaxial sleeve to an RF signal ground-providing cylinder surrounding the center pin, and to hermetically join the dissimilar coaxial sleeve to an RF connector retention bore of an aluminum support housing.
Figure 6:
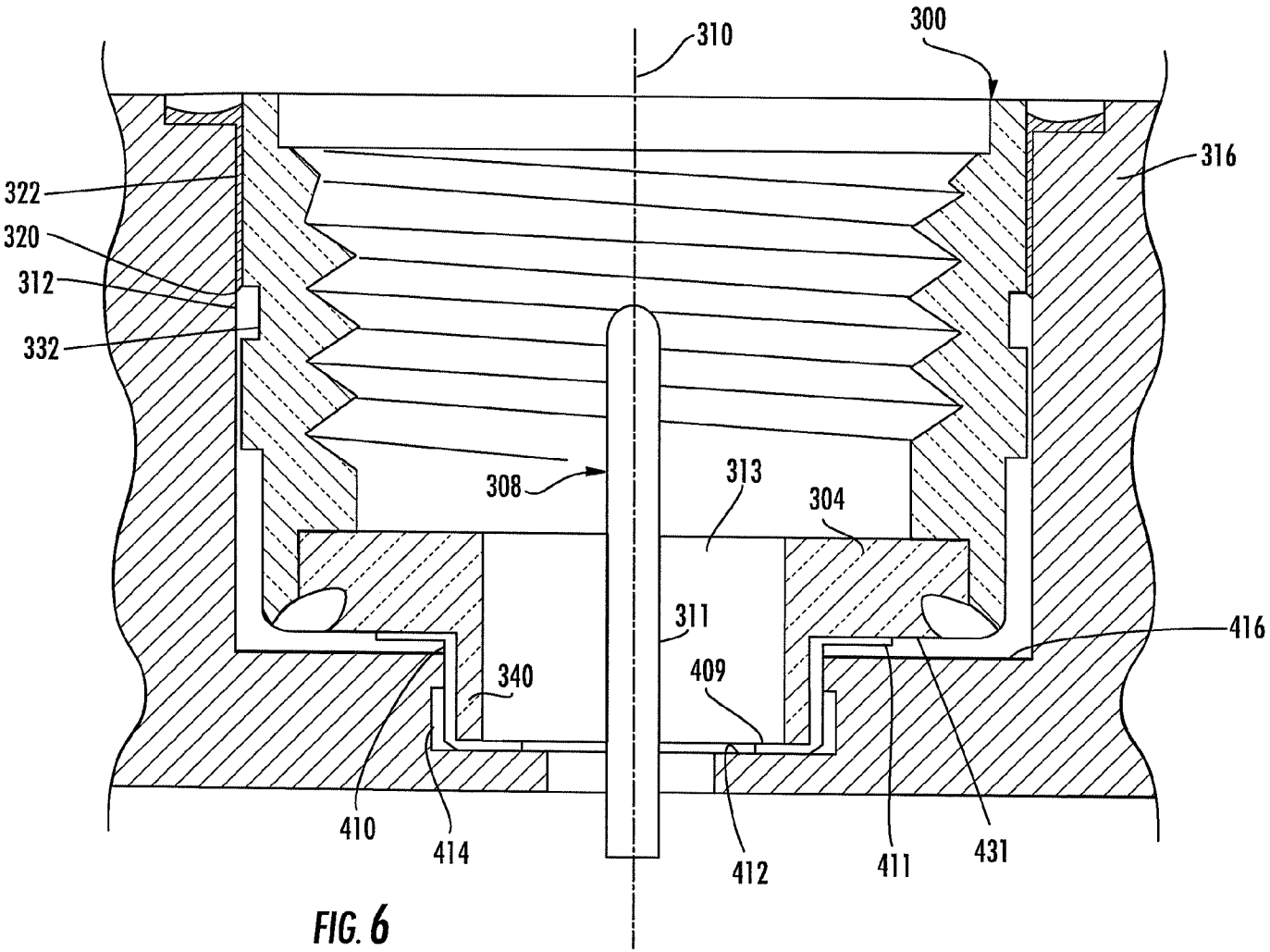
FIG. 6 is a diagrammatic cross-section of a modification of the embodiment of the coaxial type feed-through RF connector shown in FIG. 5, employing a grounding spring in lieu of a solder joint to provide a secure ohmic RF signal ground connection between the connector shell and its surrounding conductive housing.

Such a modification is diagrammatically shown in FIG. 6, wherein, as in the case of the grounding spring of the connector of FIG. 3, glass spacer 313 abuts against a bottom portion 409 of an electrically conductive grounding spring 410. Grounding spring 410 is installed at the bottom 412 of cylindrical recess 414 that is contiguous with and extends beneath the bottom portion 416 of the bore 314 formed into the housing 316 from its top surface 318. In the connector's installed position, the reduced diameter portion 340 of the Kovar ferrule 304 is urged against the bottom portion 409 of the grounding spring 410, so that the bottom portion 409 of the grounding spring 410 is firmly captured between the Kovar ferrule 304 and the bottom 412 of the recess 414. In addition, an upper portion 411 of the grounding spring 410 abuts against a bottom surface 431 of the Kovar ferrule 304. As a result, grounding spring 410 provides a secure RF ohmic signal ground connection between Kovar ferrule 304 and the conductive material of the housing 316.

Figure 1:
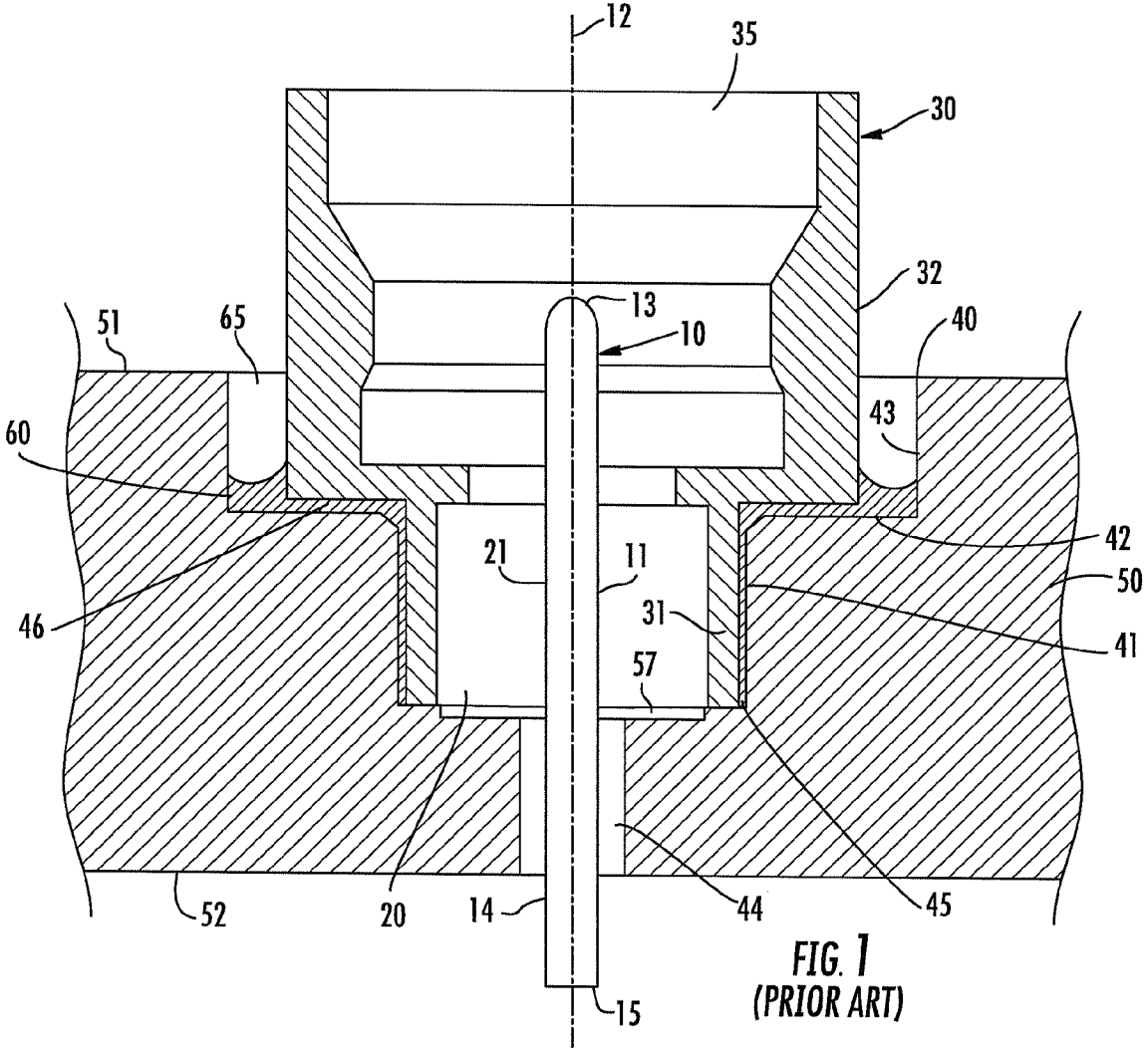
FIG. 1 (PRIOR ART)
FIG. 1 is a diagrammatic cross-sectional illustration of a first type of conventional coaxial feed-through RF connector, having an RF signal ground-providing Kovar shell that projects outwardly beyond the surface of an aluminum housing in a bore of which the RF connector is soldered.
Figure 2:
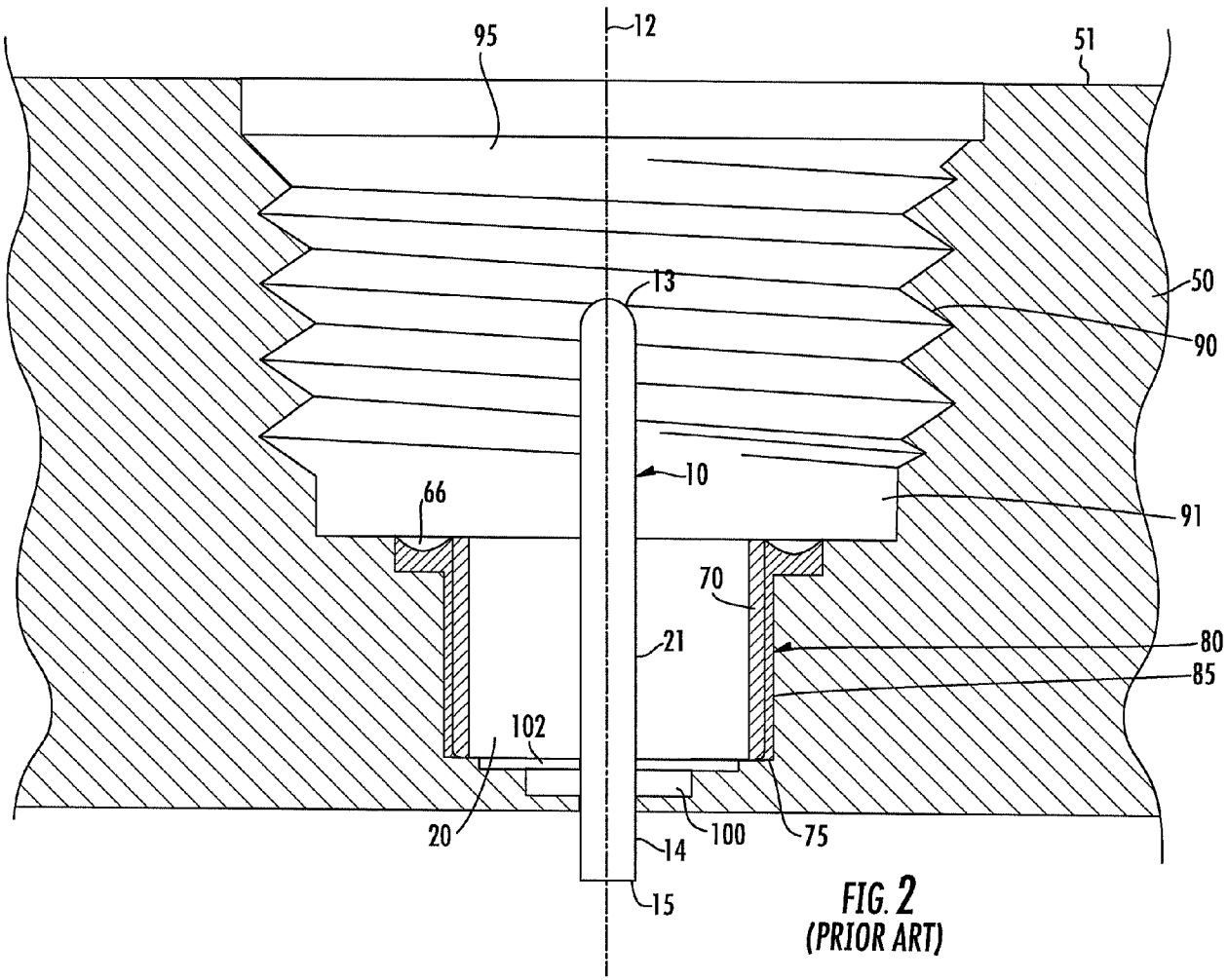
FIG. 2 (PRIOR ART)
FIG. 2 is a diagrammatic cross-sectional illustration of a second type of conventional coaxial feed-through RF connector, which is installed within a partially threaded bore of a support housing, the threaded portion of the bore allowing an externally threaded RF connector to be screwed into the bore and engage the connector's RF signal center pin.

As will be appreciated from the foregoing description, the lack of reliable hermeticity in solder joints used to join metals with substantially different CTEs, such as those employed in RF connector structures of the types shown in FIGS. 1 and 2, and the relatively complicated and costly processing techniques required to produce explosion- and laser-welds employed in RF connector structures of the type shown in FIG. 3, are effectively obviated by the coaxial feed-through RF connector of the present invention, which has a configuration and contains structural materials that enable the connector to be reliably hermetically sealed within a bore of an electronics-containing support housing made of a relatively high coefficient of thermal expansion (CTE) material (such as aluminum), by means of a relatively simple solder joint.

In particular, the coaxial feed-through RF connector according to the present invention employs an RF signal ground-providing shell, that combines a stainless steel sleeve with an adjoining Kovar ferrule. The stainless steel sleeve provides the shell with a conductive material having a CTE (17.5) that is sufficiently close to the relatively high CTE (22) of aluminum, so as to enable the connector to be reliably hermetically sealed with the housing, by mean of a relatively simple solder joint formed between the stainless steel sleeve portion of the shell and the aluminum housing. Moreover, the slightly higher value of the CTE of the aluminum housing relative the value of the CTE of the stainless steel sleeve causes the solder joint therebetween to retain the stainless steel sleeve under a slight compression, which is desirable for maintaining the reliability of the hermetic seal. The adjoining Kovar ferrule is also ohmically connected to the housing, as by way of a solder joint or grounding spring. Although this ohmic connection is non-hermetic, it provides a secure ohmic RF signal ground connection between the housing and the RF connector's conductive shell.

While I have shown and described several embodiments in accordance with the present invention, it is to be understood that the same is not limited thereto but is susceptible to numerous changes and modifications as known to a person skilled in the art, and I therefore do not wish to be limited to the details shown and described herein, but intend to cover all such changes and modifications as are obvious to one of ordinary skill in the art.

What is claimed:

1. A coaxial feed-through radio frequency (RF) connector for installation in a bore of a conductive housing made of a first material having a first coefficient of thermal expansion (CTE), comprising:

an RF signal ground-providing conductive shell comprising a conductive sleeve made of a second material having a second CTE less than the first CTE, and a conductive ferrule joined thereto;

said conductive ferrule being made of a third material having a third CTE less than the second CTE;

said conductive ferrule surrounding and being spaced from an RF signal pin made of said third material by dielectric material of a spacer hermetically joined thereto, said dielectric spacer having a fourth CTE proximate the third CTE;

said conductive ferrule being conductively coupled to the housing to provide a secure ohmic RF signal ground connection between the housing and said RF signal ground-providing shell;

said coaxial feed-through RF connector being hermetically sealable within the bore of the housing by a solder joint between said conductive sleeve and the bore to retain the coaxial feed-through RF connector in the bore under compression.

2. The coaxial feed-through RF connector according to claim 1, wherein said conductive ferrule is conductively coupled to said housing by a further solder joint.

3. The coaxial feed-through RF connector according to claim 1, wherein said conductive ferrule is conductively coupled to said housing by a grounding spring.

4. The coaxial feed-through RF connector according to claim 1 wherein said housing comprises aluminum, said conductive sleeve comprises stainless steel, and said conductive ferrule comprises Kovar.

5. The coaxial feed-through RF connector according to claim 1, wherein said conductive sleeve is welded to said conductive ferrule.

6. The coaxial feed-through RF connector according to claim 1, wherein said conductive sleeve is adjacent to a sidewall of said bore, which is formed within a raised cylindrical land portion of said housing, so as to provide a gap therebetween in which said solder joint is formed.

7. The coaxial feed-through RF connector according to claim 1, wherein said conductive sleeve is adjacent to a sidewall of said bore, so as to provide a gap therebetween in which said solder joint is formed, and wherein said conductive sleeve has a threaded internal surface, that allows an associated externally threaded RF connector to be screwed into said sleeve and engage said RF signal pin.

8. The coaxial feed-through RF connector according to claim 1 having a plurality of RF signal pins.

9. An electronic device comprising:

a feed-through radio frequency (RF) connector comprising an electrically conductive shell comprising a monolithic electrically conductive outer sleeve having a first coefficient of thermal expansion (CTE) throughout, and an electrically conductive inner ferrule joined to said electrically conductive outer sleeve and having a second CTE different than the first CTE;

an electrically conductive housing having an opening therein for receiving said electrically conductive shell and having a third CTE different from the first and second CTEs; and at least one solder joint between said electrically conductive housing and said electrically conductive shell to form a hermetic seal therebetween.

10. The electronic device according to claim 9 wherein the third CTE is higher than the first CTE.

11. The electronic device according to claim 9 wherein the at least one solder joint comprises a first solder joint between said electrically conductive housing and said electrically conductive outer sleeve, and a second solder joint between said electrically conductive housing and said electrically conductive inner ferrule.

12. The electronic device according to claim 9 further comprising a grounding spring coupled between said electrically conductive inner ferrule and said electrically conductive housing.

13. The electronic device according to claim 9 wherein said feed-through RF connector further comprises a weld joint between said electrically conductive outer sleeve and said electrically conductive inner sleeve.

14. The electronic device according to claim 9 wherein said feed-through RF connector further comprises:

a dielectric spacer within said electrically conductive inner ferrule and having at least one opening therein;

at least one RF signal pin within the at least one opening.

15. The electronic device according to claim 14 wherein said dielectric spacer comprises glass.

16. The electronic device according to claim 9 wherein said electrically conductive housing comprises aluminum.

17. The electronic device according to claim 9 wherein said electrically conductive outer sleeve comprises stainless steel.

18. The electronic device according to claim 9 wherein said electrically conductive inner ferrule comprises Kovar.

* * * * *